US006236421B1

(12) United States Patent
Imai

(10) Patent No.: US 6,236,421 B1
(45) Date of Patent: May 22, 2001

(54) THERMAL RECORDING APPARATUS

(75) Inventor: Shinji Imai, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/552,717

(22) Filed: Apr. 19, 2000

(30) Foreign Application Priority Data

Apr. 19, 1999 (JP) ..... 11-110639

(51) Int. Cl.[7] ..... B41J 2/32; B41J 2/38; B41J 2/44

(52) U.S. Cl. ..... 347/172; 347/224; 347/171; 347/175; 347/187; 347/212

(58) Field of Search ..... 347/175, 171, 347/172, 224, 185, 187, 212, 221

(56) References Cited

U.S. PATENT DOCUMENTS 5,909,232 * 6/1999 Goto et al. ..... 347/224

FOREIGN PATENT DOCUMENTS 61-291183 12/1986 (JP) ..... B41M/5/18
5-24219 2/1993 (JP) ..... B41J/2/32
5-301447 11/1993 (JP) ..... B41M/5/26
6-198925 * 7/1994 (JP) .
6-198924 7/1994 (JP) ..... B41J/2/32
7-164651 6/1995 (JP) ..... B41J/2/32
9-20021 1/1997 (JP) ..... B41J/2/32
9-20028 1/1997 (JP) ..... B41J/2/38

* cited by examiner

*Primary Examiner*—Huan Tran
(74) *Attorney, Agent, or Firm*—Sughrue, Mion, Zinn, Macpeak & Seas, PLLC

(57) ABSTRACT

The thermal recording apparatus includes an image recording device and a light irradiation device. The image recording device records an image by heating imagewise a thermal recording material. This material includes a color forming agent and a developer and optionally a light absorption dye on a substrate and is colored at a density corresponding to an added thermal energy. The light irradiation device irradiates light containing an absorption wavelength of 400 nm to 700 nm of a color forming dye of the thermal recording material to the thermal recording material heated and colored by the image recording device. The apparatus can form an image with a high contrast at a high sensibility while a sufficient dynamic range is secured, and the stability of the formed image is also high.

6 Claims, 3 Drawing Sheets

THERMAL RECORDING APPARATUS

BACKGROUND OF THE INVENTION

The present invention relates to a thermal recording apparatus for carrying out image recording by heating a thermal recording material imagewise.

Conventionally, an image photographed through an ultrasonic diagnosis, CT diagnosis, MRI diagnosis, X-ray diagnosis, or the like is recorded on a silver salt photosensitive material to output as a hard copy.

The silver salt photosensitive material provides a high quality image. However, a wet development process such as color development, fixation bleaching, and washing, is required. Accordingly, it takes time and labor to perform the development process, and also takes labor to conduct maintenance of a developer (photosensitive material processor, simply say processor). Thus, it is desired to provide an output of a hard copy through an image forming method that requires no wet development process.

As an image forming method that requires no wet process, a thermal image recording has been known. In the thermal image recording, a thermal recording material that develops a color through heating is used. This is heated imagewise in accordance with a recording image, so that a hard copy on which a visible image is formed can be obtained. There has been developed a thermal recording material that is suitable for the thermal image recording and develop a color at a density corresponding to an added thermal energy, thereby being capable of obtaining a high quality thermal image recording. This material has been proposed as Japanese Patent Application Nos. Hei 3-62684 and Hei 3-187494.

The thermal image recording is normally carried out using a light beam or a thermal head for heating the thermal recording material.

For example, in the thermal image recording by the light beam, the light beam for heating the thermal recording material to develop a color is modulated in accordance with a recording image. This light beam is deflected in the main scan direction, and auxiliary-scan conveying of the thermal recording material is made in the direction perpendicular to the main scan direction, while the thermal recording material is held at a predetermined image recording position. As a result, the light beam two-dimensionally scans the thermal recording material to heat imagewise, and the image is then recorded.

On the other hand, the thermal head includes a glaze in which heat generating elements are arranged in one direction (main scan direction). The thermal image recording using the thermal heads is carried out in such a manner that in a state that the glaze is pressed against a thermal recording material, the respective heat generating elements are heated in accordance with a recording image, while both are relatively moved in the direction perpendicular to the main scan direction. As a result, the thermal recording material is heated imagewise.

The image quality of such a thermal recording image is greatly improved in recent years. Recently, in addition to a recording of an ultrasonic diagnosis image in which the thermal image recording is conventionally used, its application is examined in which a large and high quality image is required, such as CT diagnosis, MRI diagnosis, or X-ray diagnosis.

By the way, in such a thermal recording material, for the purpose of maintaining a stable preservation state thereof, the material is formed (designed) so that color forming or coloring does not occur with a low thermal energy and coloring does not occur unless a thermal energy not lower than a predetermined amount (threshold value) is added.

Thus, in order to obtain an image of a predetermined coloring state by only imagewise heating, a very high thermal energy is required. A light beam or a thermal head for performing the thermal image recording is required to have a capacity to cope with such a high thermal energy, which causes an increase in the cost of an apparatus and an increase in the size thereof. Besides, there is also a problem in that the dynamic range of the thermal recording apparatus becomes narrow by the amount of the threshold value of coloring, and the gradation is also lowered in accordance with that amount.

In order to solve such problems, there has been and proposed a thermal recording method and an apparatus for heating a thermal recording material to a temperature not higher than a coloring temperature at a time before and/or after a thermal image recording (see Japanese Patent Application Laid-open Nos. Hei 6-198924, Hei 6-198925, Hei 7-164651, etc.).

According to these, even by a low thermal energy, a thermal image recording sufficiently securing a dynamic range can be carried out, and a high quality image can be stably obtained at an excellent sensibility while superior image stability after the recording is also secured.

However, in recent years, a request for picture (image) quality of various images becomes severe. Particularly, the foregoing hard copy to be used for medicine is required to have a high quality for carrying out more accurate diagnosis. Therefore, the thermal image recording is also required to have a more excellent sensibility, image stability after the recording, a higher contrast, and the like.

SUMMARY OF THE INVENTION

The present invention has been made to solve the foregoing problems associated with the conventional technique, and therefore has an object thereof to provide a thermal recording apparatus for carrying out thermal image recording by using a thermal recording material which includes a color forming agent and a developer and optionally a light absorption dye on a support base, and is colored at a density corresponding to an added thermal energy, in which an image with a high contrast can be formed at a high sensibility while a sufficient dynamic range is secured, and the stability of the formed image is also high.

In order to achieve the foregoing object, according to the invention, a thermal recording apparatus comprises an image recording device for recording an image by heating imagewise a thermal recording material, which includes a color forming agent and a developer and optionally a light absorption dye on a substrate and is colored at a density corresponding to an added thermal energy; and a light irradiation device for irradiating light containing an absorption wavelength of 400 nm to 700 nm of a color forming dye of the thermal recording material to the thermal recording material heated and colored by the image recording device.

Besides, it is preferable that the thermal recording apparatus further comprises at least one of a preheating device for heating the thermal recording material to a temperature not higher than a coloring temperature before the image is recorded by the image recording device, a postheating device for heating the thermal recording material to a temperature not higher than the coloring temperature after the image is recorded by the image recording device, and a fixation light irradiation device for irradiating fixation light to the thermal recording material after the light irradiation device irradiates the light.

Further, it is preferable that the thermal recording material comprises a thermal layer including a microcapsule containing a basic dye precursor as the color forming dye, the developer, and optionally the light absorption dye.

DETAILED DESCRIPTION OF THE PREFERRED EMBODIMENTS

Hereinafter, preferred embodiments of a thermal recording apparatus of the invention will be described with reference to the drawings.

Figure 1:
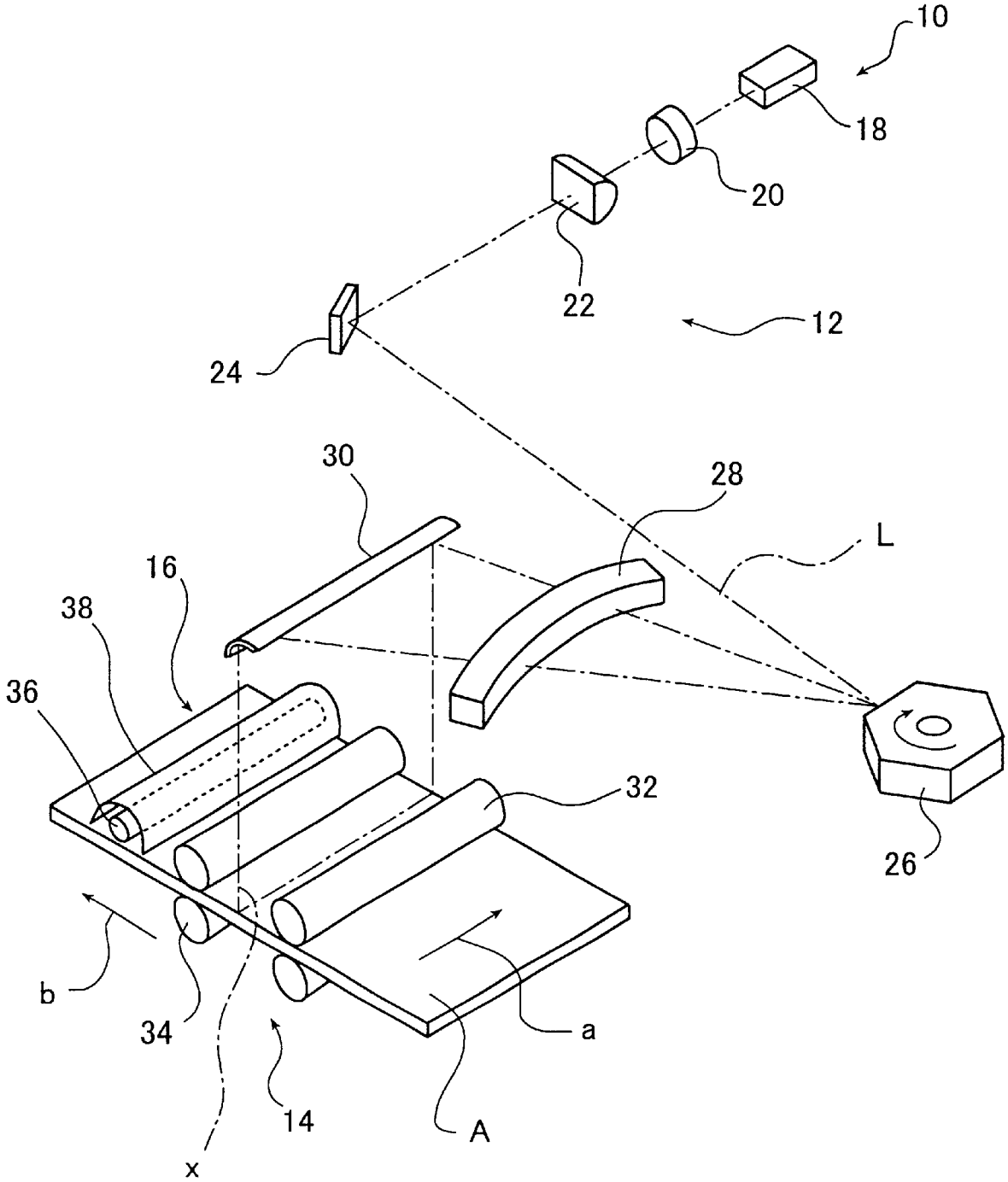
FIG. 1 is a schematic perspective view of an embodiment of a thermal recording apparatus of the invention.

FIG. 1 is a schematic perspective view of an embodiment of a thermal recording apparatus of the invention.

A thermal recording apparatus 10 shown in FIG. 1 is an apparatus for carrying out thermal image recording by exposing a thermal recording material A (hereinafter referred to as a "thermal material A") imagewise to a light beam L for recording thermally (heat mode laser), and basically includes a light beam scanning optical system 12 and auxiliary-scan conveying device 14 which constitute image recording device, and light irradiation device 16 for irradiating the thermal recording material A after recording with light having a wavelength of 400 nm to 700 nm as an absorption wavelength of a color forming dye of the thermal material A.

The thermal material A used in the thermal recording apparatus 10 of the invention includes a color forming agent and a developer on a substrate, and optionally a light absorption dye, and is a material colored at a density corresponding to an added thermal energy. Preferably, the thermal material A includes a thermal recording layer formed by adding a microcapsule containing at least a basic dye precursor, and the developer, and optionally the light absorption dye into an organic solvent slightly soluble or insoluble in water, preparing an emulsified and dispersed coating liquid (emulsion), and applying this coating liquid onto the substrate.

The basic dye precursor has properties to form a color by supplying an electron or receiving a proton such as an acid, and uses such a compound which is normally colorless (or almost colorless), has a partial skeleton of lactone, tactam, salton, spiropyran, ester, amido, or the like, and comes in contact with the developer so that the skeleton portion ring-opens or cleaves to form the color.

Specifically, crystal violet lactone, benzoyl leucomethylene blue, mica light green lactone, rhodamin B-lactam, 1, 3, 3-trimethyl-6' ethyl-8'-butoxy indolino benzospiropyran, and the like are exemplified.

Incidentally, the microcapsule containing such the basic dye precursor may be formed by well-known method and device in the art.

As the developer to the color forming agent, an acid material such as phenol compounds, organic acids or those metal salts, or oxybenzoic ester is used.

It is preferable that a melting point of the developer is 50° C. to 250° C., and particularly phenol or organic acid having the melting point of 60° C. to 200° C., and insoluble to water is desirable.

Such a developer is disclosed in detail in Japanese Patent Application Laid-open No. Sho 61-291183.

It is desirable that the light absorption dye is a dye having less absorption of light in a visible light region and particularly high absorptance for a wavelength of infrared region. Particularly, in view of the fact that a semiconductor laser radiating near infrared light is put to practical use, a dye having high absorptance wavelength in a near infrared light region of 700 nm to 900 nm is preferably used.

As the dye, cyanine-based dye, phthalocyanine-based dye, pyrylium-based dye, thiopyrylium-based dye, azulenium-based dye, squalerium-based dye, metal complex-based dye of Ni (nickel), Cr (chromium), or the like, naphthoquinone-based dye, anthraquinone-based dye, indophenol-based dye, indoaniline-based dye, triphenylmethane-based dye, triarylmethane-based dye, nitroso-based compound, and the like are exemplified.

In the thermal material A used in the invention, such a light absorption dye is indispensable when thermal image recording is carried out through heating by the light beam L as in the example shown in the drawing, and in order to improve an effect of light irradiation by the light irradiation device 16, it is preferable that such a light absorption dye is also contained when thermal image recording is carried out by a thermal head described later.

As described above, the thermal material A includes the thermal recording layer formed by preparing the emulsified and dispersed coating liquid, applying this to the substrate, and drying. A preparing method or applying method of the coating liquid is not particularly limited, and a well-known method used for preparation of a thermal material or photosensitive material may be used.

The substrate is not limited either, and various materials used for the well-known thermal material A, for example, a resin film such as a polyester film, polyethylene terephthalate (PET) film, polyethylene naphthalate film, cellulose nitrate film, polyvinyl acetal film, or polycarbonate, various metals such as aluminum, zinc, or copper, glass, or paper can be used.

In this thermal material A, Tg (glass transition temperature) of the microcapsule is lowered by heating, the developer passes through the microcapsule and comes in contact with the color forming agent, and by this, as described above, the color forming agent reacts to form the color.

Such a thermal (recording) material is disclosed in detail in Japanese Patent Application Nos. Hei 3-62684 or Hei. 3-187494 by the applicant of the present invention.

The light beam scanning optical system 12 constituting the image recording device exposes such thermal material A to the light beam L and heats it imagewise, so that an image is recorded. The light beam scanning optical system is well known and is constituted by combining a light source of the light beam L, a light deflector, an fθ (scan) lens, and the like. In the embodiment shown in the drawing, the light beam scanning optical system 12 is constructed by a light source 18 of the light beam L, a collimator lens 20, a cylindrical lens 22, a mirror 24, a polygon mirror 26, an fθ lens 28, and a cylindrical mirror 30.

The light source 18 is a light source of the light beam L for heating the thermal material A to record an image, and is driven by a not-shown driver, and radiates the light beam L modulated in response to the image to be recorded. As the light source 18, in view of the progress of coloring by the action of the light irradiation device 16 described later, various light sources capable of radiating the light beam L having a sufficient amount of heat for coloring of the thermal material A can be used, and in the illustrated example, a semiconductor laser (LD) is used as an example.

A method of modulating a light beam is not particularly limited, and a pulse (width or number) modulation or intensity modulation (pulse amplitude modulation) may be used. In the illustrated example, the LD is used as the light source 18, and drive control is performed so that thermal image recording is carried out by a direct modulation. However, the invention is not limited to this, but an external modulator such as an AOM (acousto optic modulator) may be used.

The light beam L radiated from the light source 18 is shaped into parallel light by a collimator lens 20, and is incident on the cylindrical lens 22. The cylindrical lens 22, together with the cylindrical mirror 30, constitutes a surface tilt correction optical system.

The light beam having passed through the cylindrical lens 22 is reflected by the mirror 24 in a predetermined direction, and is deflected by the polygon mirror 26 as the light deflector in the main scan direction (direction of an arrow "a" in FIG. 1).

The light beam deflected in the main scan direction is adjusted by the fθ lens 28 so that imaging is made on a predetermined recording position x (scan line) to have a predetermined beam diameter. The beam is directed down by the cylindrical mirror 30 which, together with the cylindrical lens 22, constitutes the surface tilt correction optical system, and is incident on the recording position x.

The auxiliary-scan conveying means 14, together with the light beam scan optical system 12, constituting the image recording device conveys the thermal material A in the auxiliary-scan direction (direction of an arrow "b" in FIG. 1) perpendicular to the main scan direction, while holding the thermal material A (its surface) at the recording position x. In the illustrated example, the auxiliary-scan conveying device 14 includes a pair of conveying roller pairs 32 and 34 disposed at both sides of the recording position (scan line) x and for conveying the thermal material A while holding the thermal material A at the recording position x.

As described above, since the light beam L modulated in response to the recording image is deflected in the main scan direction, the thermal material A conveyed by the scan conveying device 14 in the auxiliary-scan direction is two-dimensionally scanned by the light beam L, and is heated imagewise, so that coloring occurs at a density corresponding to the heating amount, that is, given heat energy.

At the downstream side in the auxiliary-scan conveying direction of the scan conveying device 14 (hereinafter referred to as "downstream"), the light irradiation portion 16 is disposed, which irradiates the thermal material A heated so as to have an image and colored by the image recording device composed of the light beam scanning optical system 12 and the auxiliary-scan conveying device 14 with light including a wavelength of 400 nm to 700 nm (all region or only its part may be included) and being absorbed by a color forming dye of the thermal material A. The thermal material A is conveyed in the auxiliary-scan conveying direction, and the whole surface is uniformly exposed by this light irradiation device 16, and then, the thermal material is discharged to a not-shown discharge tray or the like as a hard copy on which an image is formed.

In the illustrated example, the light irradiation device 16 is composed of a rod-like halogen lamp 36 extending in the main scan direction and a reflector 38 extending in the same direction and for reflecting light radiated from the halogen lamp 36 to the thermal material A.

Although the thermal material A is colored by heating, as described above, it is difficult to sufficiently form the color at a desired density only through the image formation heating by the light beam L or the like. As described above, by heating the thermal material A to a temperature not higher than a coloring temperature before recording of the image or after recording (hereinafter, heating before recording is referred to as "pre-heating", and heating after recording is referred to as "post-heating"), a dynamic range is secured, and high sensitivity and image stability after recording is realized. In this method, since the whole surface of the thermal material is heated by using a heater, far infrared rays absorbed by the foregoing substrate of the thermal material, or near infrared rays (wavelength of 700 nm to 900 nm) absorbed by the foregoing light absorption dye contained in the thermal material, the excellent dynamic range can be secured. However, coloring of an unnecessary region is also accelerated by the heating, and there is a case where slight fogging occurs on the image.

In the thermal apparatus of the invention, such heating is not carried out, but light irradiation is used to accelerate coloring of the thermal material, so that more excellent thermal image recording is realized than the pre-heating or post-heating.

Figure 2:
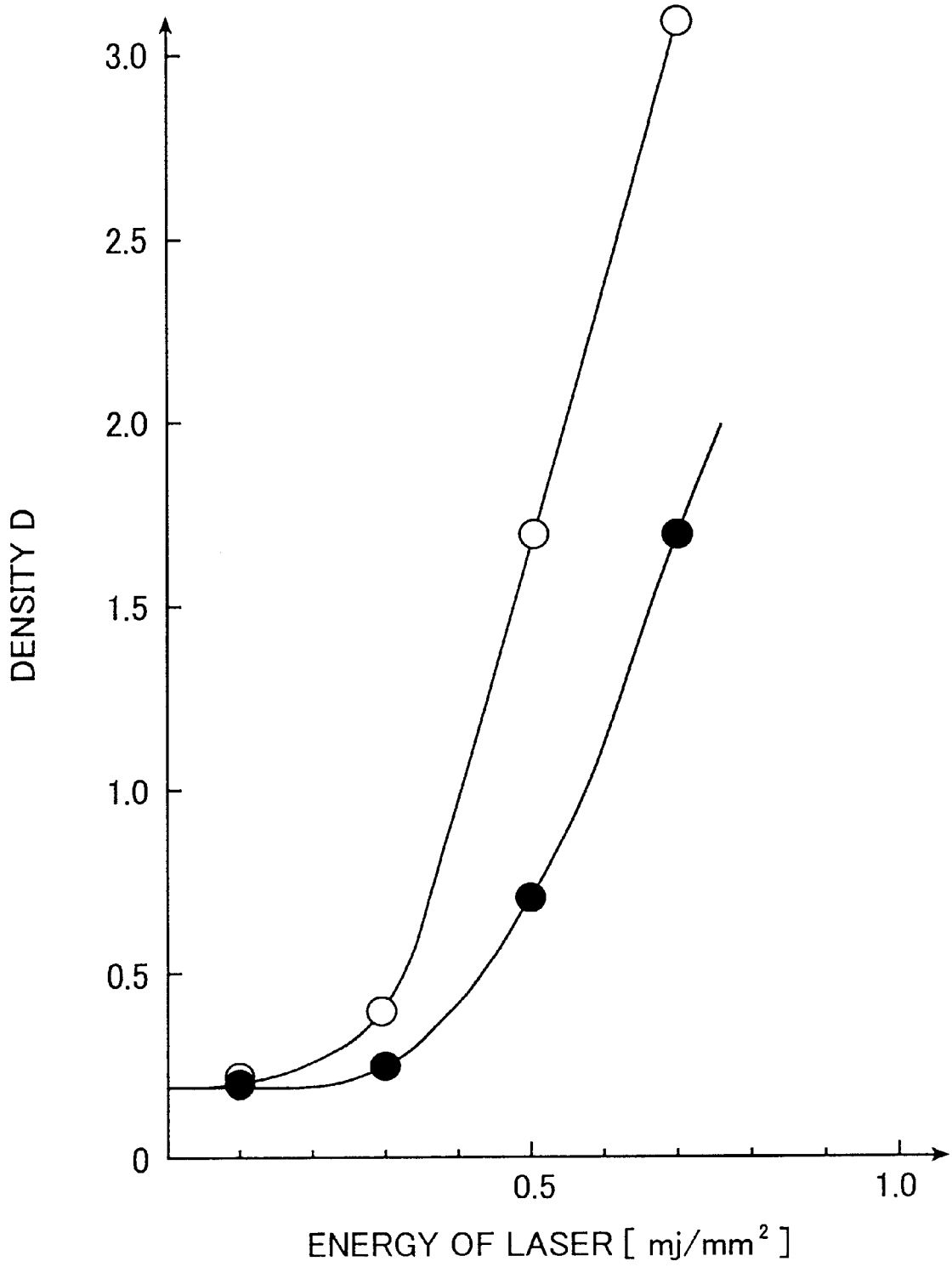
FIG. 2 is a graph showing density change of a thermal recording image by post-lighting.

FIG. 2 shows an embodiment of a density change when in the thermal material using the microcapsule, the thermal material A colored by heating is irradiated with light including an absorption wavelength of the coloring dye of the thermal material A. More specifically, FIG. 2 shows a change of density D when the thermal material A colored by irradiation of a laser of various energies is uniformly irradiated with white light on the whole surface of the thermal material for 20 seconds by using a halogen lamp (made by Olympus Co., Ltd., U-LH100) of 100W.

As shown in FIG. 2, when the thermal material A colored by heating is irradiated with light containing the absorption wavelength of the coloring dye of the thermal material A (hereinafter, the irradiation is referred to as "post-lighting"), coloring is further progressed and the density can be made high.

It is considered that one of factors of the progress of this coloring is that a coloring region of the thermal material A absorbs light containing the wavelength of 400 nm to 700 nm to convert the light to heat, and the coloring region is further heated by this heat, so that the reaction further progresses. Thus, also as shown in FIG. 2, the density change by the post-lighting is great in a region where coloring is made at a high density. In addition, since light by the post-lighting merely passes through a non-coloring portion (fog region) or is reflected at it, no change occurs at the non-coloring portion. That is, the occurrence of fogging as described above does not take place.

Thus, according to the thermal recording apparatus of the invention, in addition to the increase of density of a formed image by the post-lighting, secureness of the dynamic range resulting therefrom and improvement of sensitivity, and stabilization of the image, the improvement of contrast of the image can also be realized, and it is possible to realize clear and high quality thermal image recording without fogging.

Particularly, in the thermal material using the foregoing microcapsule, also as shown in FIG. 2, the microcapsule once colored is in a state where coloring by the post-lighting is extremely apt to progress, and the reaction of the microcapsule as a coloring unit can be made saturated, so that the image becomes stable, and the increase of density more than necessity does not occur. Thus, by carrying out the post-lighting, only necessary coloring is made to sufficiently progress, and it is possible to stably form an image (hard copy) with high density and high contrast, high image stability, and high quality.

Besides, according to the thermal recording apparatus of the invention, since the image recording device can be designed in view of coloring (improvement in image density) by the post-lighting, for example, by reducing the output of the light beam L or thermal head for heating the thermal material A, the recording apparatus can be made downsized and inexpensive.

In the thermal recording apparatus of the invention, the light irradiation device 16 for carrying out the post-lighting is not limited to the combination of the halogen lamp 36 and the reflector 38 in the illustrated embodiment, but it is possible to employ various well-known light irradiation devices which use a light source emitting light with a wavelength absorbed by the color forming dye of the thermal material A to be used, and further, which use, as the need arises, a combination of a reflector, light transmission device, and the like. However, as the light source, the halogen lamp of the illustrated embodiment is preferably exemplified.

Besides, in the illustrated embodiment, scanning is made by the rod-type light source so that the uniform post-lighting on the whole surface of the thermal material is made. However, the invention is not limited to this, but for example, rod-type light sources are arranged, or dot light sources are used, so that the uniform post-lighting on the whole surface may be carried out like a surface exposure. The post-lighting by the surface exposure may be carried out while conveying of the thermal material A is stopped or the thermal material is conveyed.

The exposure amount (luminance x irradiation time) of the thermal material A by the post-lighting is not particularly limited, but an exposure amount by which an objective image density can be obtained may be suitably set in response to the output of the image recording device (coloring density by the image recording device) or the like.

Besides, timing when the post-lighting is carried out is not particularly limited, but it may be carried out at any time after the thermal material A is colored through heating by the image recording device. However, as described above, since photothermal conversion by the light absorption of the coloring region is a great factor of density improvement by the post-lighting, the effect of improvement of the density by the post-lighting becomes high as the image density before the post-lighting is high. Thus, in view of this, the timing may be set in accordance with temporal characteristics of coloring of the thermal material A.

In the case where the thermal material A is opaque, the post-lighting is basically carried out so that light is irradiated to an image formation surface (surface) side. In the case where the thermal material A is a transparent one with a transparent PET film or the like as a substrate, the post-lighting may be carried out by irradiating light from a non-image formation (rear surface) side.

In the thermal recording apparatus of the invention, as needed, the foregoing pre-heating or post-heating may be combined with each other. By this, secureness of a wider dynamic range, improvement of sensibility, improvement of image stability, and the like can be realized more excellently.

Figure 3:
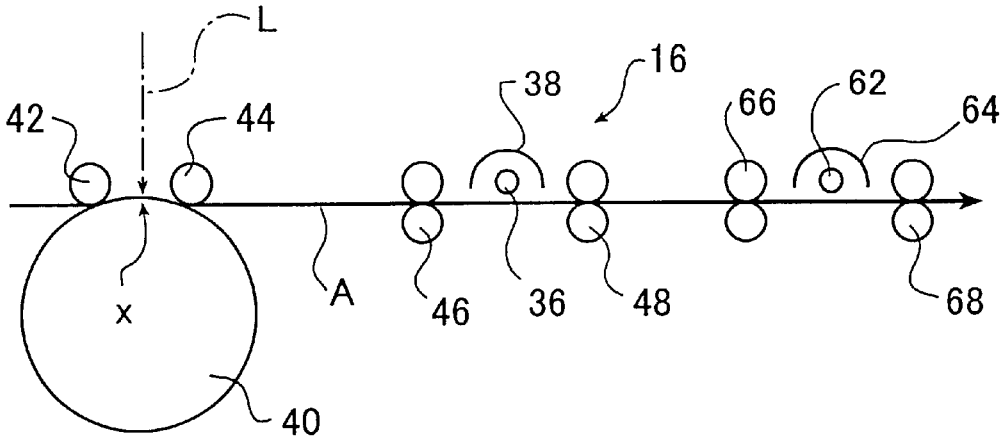
FIG. 3 is a view conceptually showing another embodiment of a thermal recording apparatus of the invention.

For example, as shown in FIG. 3, an auxiliary-scan conveying device is constructed by a platen roller 40 for conveying the thermal material A while holding it at a recording position x, and a pair of rollers 42 and 44 which come in contact with the platen roller 40 at both sides of the recording position x (scan line) and which, together with the platen roller 40, nip and convey the thermal material A, and the platen roller 40 is made to have a built-in heating device such as a heater and this is made a heat roller, whereby the thermal material A may be heated (preheated) at the same time as image recording by the light beam L.

The pre-heating is not necessarily required to be carried out at the same time as the thermal image recording as in the illustrated embodiment, but it may be carried out before the recording.

Incidentally, reference numerals 46 and 48 in the drawing respectively designate conveying roller pairs for holding and conveying the thermal material A when the post-lighting by the light irradiation device 16 is carried out.

Figure 4:
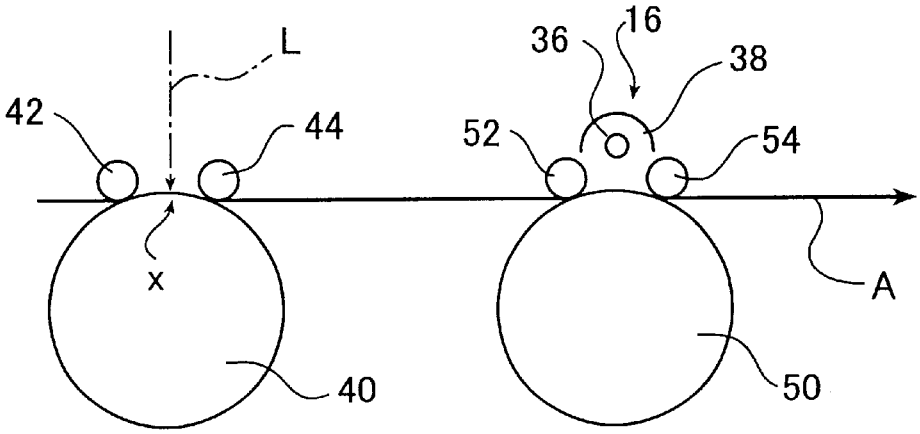
FIG. 4 is a view conceptually showing another embodiment of a thermal recording apparatus of the invention.

Further, as shown in FIG. 4, in addition to the pre-heating by the platen roller 40 serving also as auxiliary-scan conveying device, conveying of the thermal material A at the light irradiation device 16 is carried out by a similar platen roller 50 and rollers 52 and 54, the platen roller 50 is made a heat roller having built-in heating device, and the post-heating may be carried out.

When the post-heating is carried out, it is not limited to the combination with the pre-heating as shown in FIG. 4, but only the post-heating may be carried out in addition to the post-lighting. Besides, the post-heating is not limited to the case where it is carried out at the same time as the post-lighting, but it may be carried out before or after the post-lighting.

The temperature of the pre-heating and post-heating is not particularly limited, but in the case where the output of the light beam (or thermal head) or the like, or the thermal material A containing the foregoing microcapsule is used, the temperature may be suitably determined according to Tg or the like of the microcapsule. For example, when Tg of the microcapsule before coloring is 70° C. to 150° C., it is preferable that the temperature of the pre-heating or post-heating is also made 70° C. to 150° C.

Besides, although the time of the pre-heating and post-heating is not particularly limited, since heating for a long time causes fogging, it is preferable that the time is made 10 seconds or shorter.

In the thermal recording apparatus of the invention, in the case where the microcapsule of the thermal material A is made of an ultraviolet hardening-type resin, as shown in FIG. 3, an ultraviolet lamp 62 is disposed behind the post-lighting (or post-heating), and fixation of image by ultraviolet irradiation may be carried out, and by this, image stability is further improved.

In the embodiment shown in FIG. 3, the rod-type ultraviolet lamp 62 and a reflector 64 are used, and the whole surface of the thermal material A is irradiated with ultraviolet rays from the ultraviolet lamp 62 while the thermal material A is conveyed by conveying roller pairs 66 and 68 disposed at both sides of the ultraviolet lamp 62, so that fixation of an image by ultraviolet irradiation is carried out.

Incidentally, ultraviolet irradiation is not limited to the device and method of the illustrated embodiment, but any well-known light irradiation devices and methods including the exemplified device and method in the post-lighting may be used.

The foregoing pre-heating, post-heating, and ultraviolet fixation are described in detail in Japanese Patent Applications Laid-open Nos. Hei 6-198924, Hei 6-198925, Hei 7-164651, Hei 9-20021, and Hei 9-20028 by the assignee of the present invention.

Figure 5:
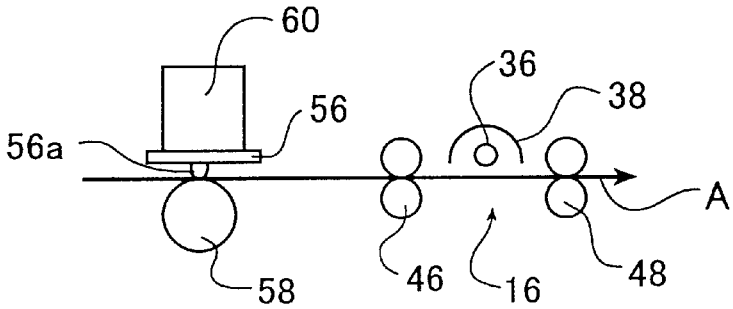
FIG. 5 is a view conceptually showing another embodiment of a thermal recording apparatus of the invention.

Although the recording apparatus 10 as described above is an apparatus for carrying out recording by exposing the thermal material A imagewise with the light beam L modulated in accordance with a recorded image, the invention is not limited to this, but it can be appropriately applied to an apparatus for carrying out recording using a thermal head 56 as shown in FIG. 5.

As is well known, the thermal head 56 includes a glaze 56*a* in which heat generating elements are disposed in one direction (main scan direction), and thermal image recording is carried out in such a manner that in the state where the glaze 56*a* is pressed against the thermal material A, both are relatively moved in a direction perpendicular to the main scan direction, and the respective heat generating elements are heated in accordance with a recorded image to heat the thermal material A imagewise. In the illustrated embodiment, thermal image recording is carried out by the thermal head 56 while the thermal material A is conveyed by a platen roller 58, and then, post-lighting is carried out at a light irradiation device 16. The thermal head 56 is cooled by a heat sink 60.

A modulation method at the time when thermal image recording is carried out by using the thermal head is also not particularly limited, but a pulse width modulation, a pulse number modulation or a pulse amplitude modulation (intensity modulation) may be used.

Besides, also in the case where such a thermal head is used, the foregoing pre-heating, post-heating, and ultraviolet fixation may be suitably combined as needed, and it is natural that excellent effects can be obtained similarly.

Although the thermal recording apparatus of the invention has been described in detail, the invention is not limited to the above embodiments, but needless to say, various improvements and modifications may be carried out within the range not exceeding the gist of the invention.

As described above in detail, according to the thermal recording apparatus of the invention, by using the thermal recording material which includes the color forming agent and the developer and optionally the light absorption dye on the substrate, and is colored at a density corresponding to an added thermal energy, high sensitive image recording is carried out while a sufficient dynamic range is secured, and a thermal recording image with high contrast and high image stability can be formed.

What is claimed is:

1. A thermal recording apparatus comprising:

an image recording device for recording an image by heating imagewise a thermal recording material, which includes either one of (1) a color forming agent, and a developer, and (2) the color forming agent, the developer, and a light absorption dye, on a substrate and is colored at a density corresponding to an added thermal energy; and a light irradiation device for irradiating light containing an absorption wavelength of 400 nm to 700 nm of a color forming dye of the thermal recording material to the thermal recording material heated and colored by the image recording device.

2. A thermal recording apparatus according to claim 1, further comprising at least one of a preheating device for heating the thermal recording material to a temperature not higher than a coloring temperature before the image is recorded by the image recording device and a postheating device for heating the thermal recording material to a temperature not higher than the coloring temperature after the image is recorded by the image recording device.

3. A thermal recording apparatus according to claim 1, wherein the thermal recording material comprises a thermal layer including either one of (1) a microcapsule containing a basic dye precursor as the color forming dye, and the developer, and (2) a microcapsule, the developer, and the light absorption dye.

4. A thermal recording apparatus according to claim 1, wherein said thermal recording material has a thermal layer on the substrate, said thermal layer includes either one of the color forming agent and the developer, and the color forming agent, the developer and the light absorption dye, and said light irradiation device irradiates said light to said thermal layer of the thermal recording material heated and colored by the image recording device.

5. A thermal recording apparatus according to claim 4, wherein said light irradiation device irradiates said light to said thermal layer from a side of the thermal layer of the thermal recording material.

6. A thermal recording apparatus according to claim 1, further comprising a fixation light irradiation device for irradiating fixation light to the thermal recording material after said light irradiation device irradiates said light.

* * * * *